US005391251A

United States Patent [19]

Shuert

[11] Patent Number: 5,391,251

[45] Date of Patent: Feb. 21, 1995

[54] METHOD OF FORMING A PALLET

[76] Inventor: Lyle H. Shuert, 1034 Stratford Pl., Bloomfield Hills, Mich. 48013

[21] Appl. No.: 826,842

[22] Filed: Jan. 28, 1992

Related U.S. Application Data

[63] Continuation-in-part of Ser. No. 524,299, May 15, 1990, abandoned.

[51] Int. Cl.[6] ..... B65D 19/32; B29C 51/02

[52] U.S. Cl. ..... 156/292; 156/210; 108/51.1; 108/901; 264/545

[58] Field of Search ..... 156/210, 292, 196, 293, 156/227; 264/545; 108/51.1, 901

[56] References Cited

U.S. PATENT DOCUMENTS

| | | | |
|---|---|---|---|
| 3,404,642 | 10/1968 | Belcher | 108/51.1 |
| 3,444,034 | 5/1969 | Hewett | 428/72 |
| 3,467,032 | 9/1969 | Rowlands | 108/51.1 |
| 3,667,403 | 6/1972 | Angelbeck | 108/51.1 |
| 3,680,496 | 8/1972 | Westlake | 108/51.1 |
| 3,699,902 | 10/1972 | Allgeyer | 108/51.1 |
| 3,707,929 | 1/1973 | Lauffer | 108/51.1 |
| 3,719,157 | 3/1973 | Arcocha | 108/51.1 |
| 3,757,704 | 9/1973 | Allgeyer | 108/51.1 |
| 3,832,955 | 9/1974 | Pottinger | 108/51.1 |
| 4,159,681 | 7/1979 | Vandament | 108/51.1 |
| 4,263,855 | 4/1981 | Lawlor | 108/901 X |
| 4,397,247 | 8/1983 | Lemelson | 108/57.1 |
| 4,428,306 | 1/1984 | Dresen et al. | 108/53.3 |
| 4,488,496 | 12/1984 | Polacco | 108/51.3 |
| 4,606,278 | 8/1986 | Shuert | 108/51.1 |
| 4,869,456 | 9/1989 | Jacobs | 108/901 X |

*Primary Examiner*—Michael W. Ball
*Assistant Examiner*—Francis J. Lorin
*Attorney, Agent, or Firm*—Young, MacFarlane & Wood

[57] ABSTRACT

A method is provided for forming a pallet including thermoforming a pair of plastic sheets and then fusing the two sheets together to form the pallet. One of the two sheets is thermoformed to provide a series of pin assemblies with each pin assembly including a plurality of hollow pin portions extending outwardly. The second sheet is thermoformed to provide a series of leg portions that define a corresponding series of grooves in the sheet, each groove corresponding to a respective pin assembly of the first sheet. The first sheet is assembled with the second sheet such that each pin assembly of the first sheet rests nestingly within the respective groove of the second sheet and then the material of the pin assemblies are fused to the material of the respective grooves. Web portions of the first sheet interconnect adjacent pin portions and are formed as folds extending outwardly in the same direction as the pin portions, but to a lesser extent.

6 Claims, 8 Drawing Sheets

FIG-10
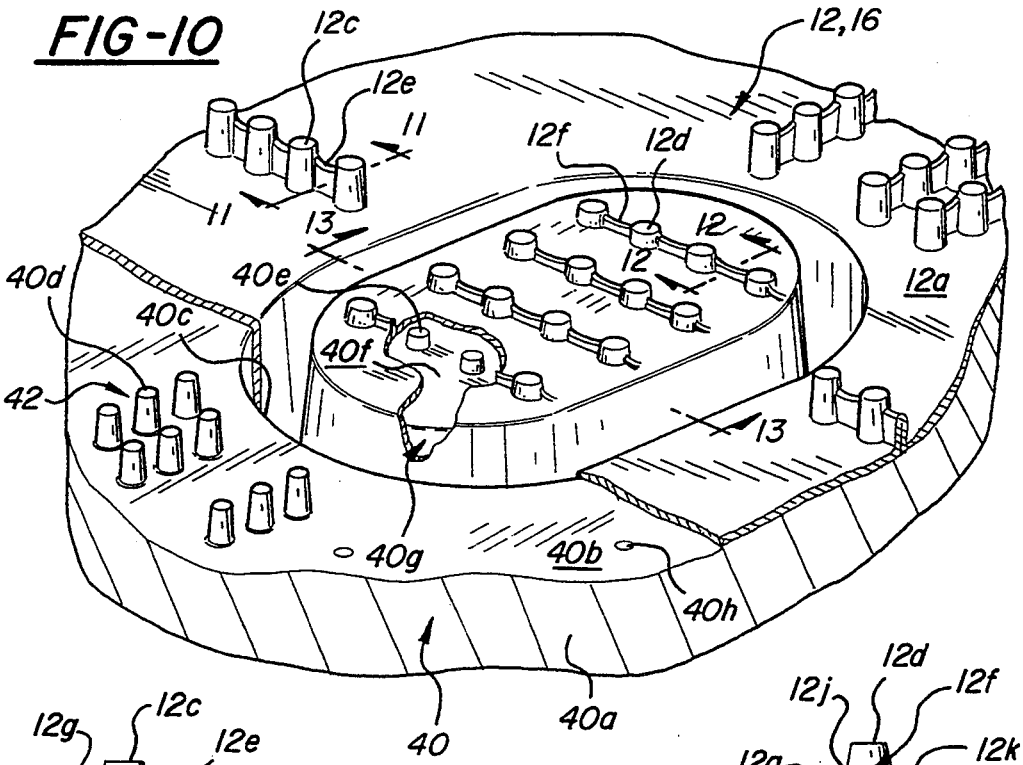
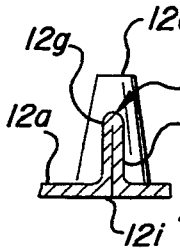
FIG-11
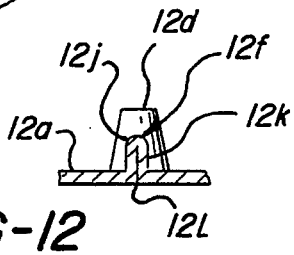
FIG-12
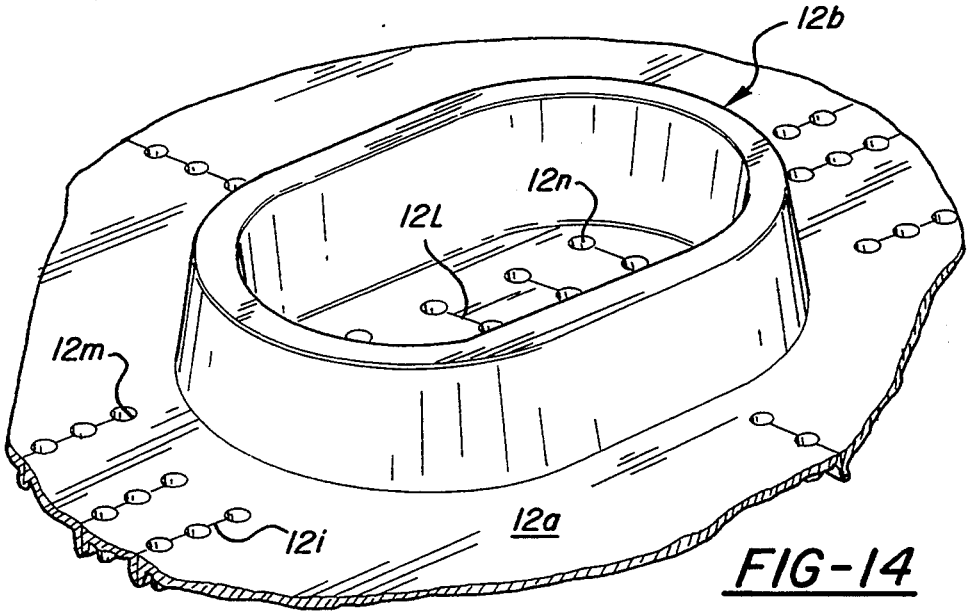
FIG-14

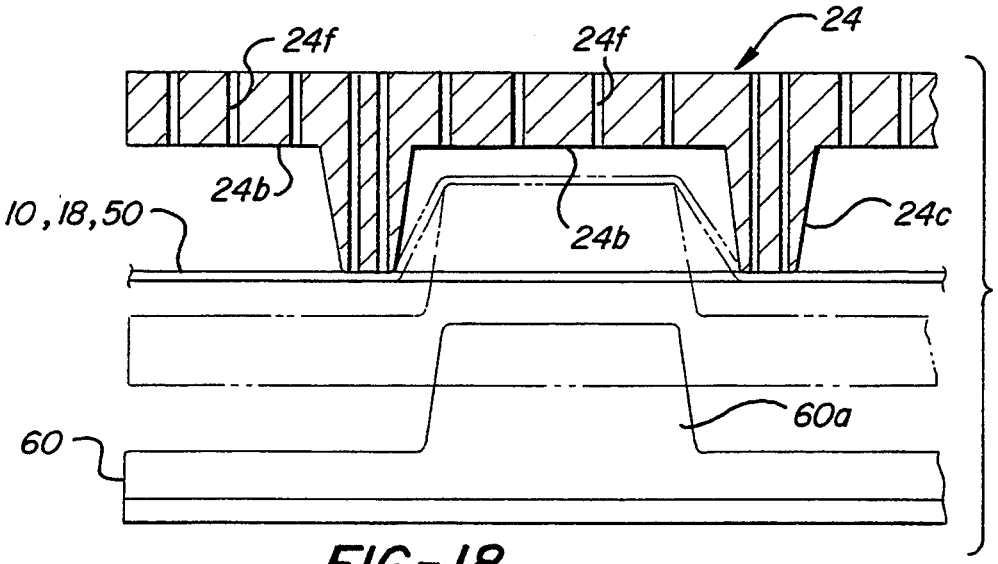
FIG-18
FIG-19
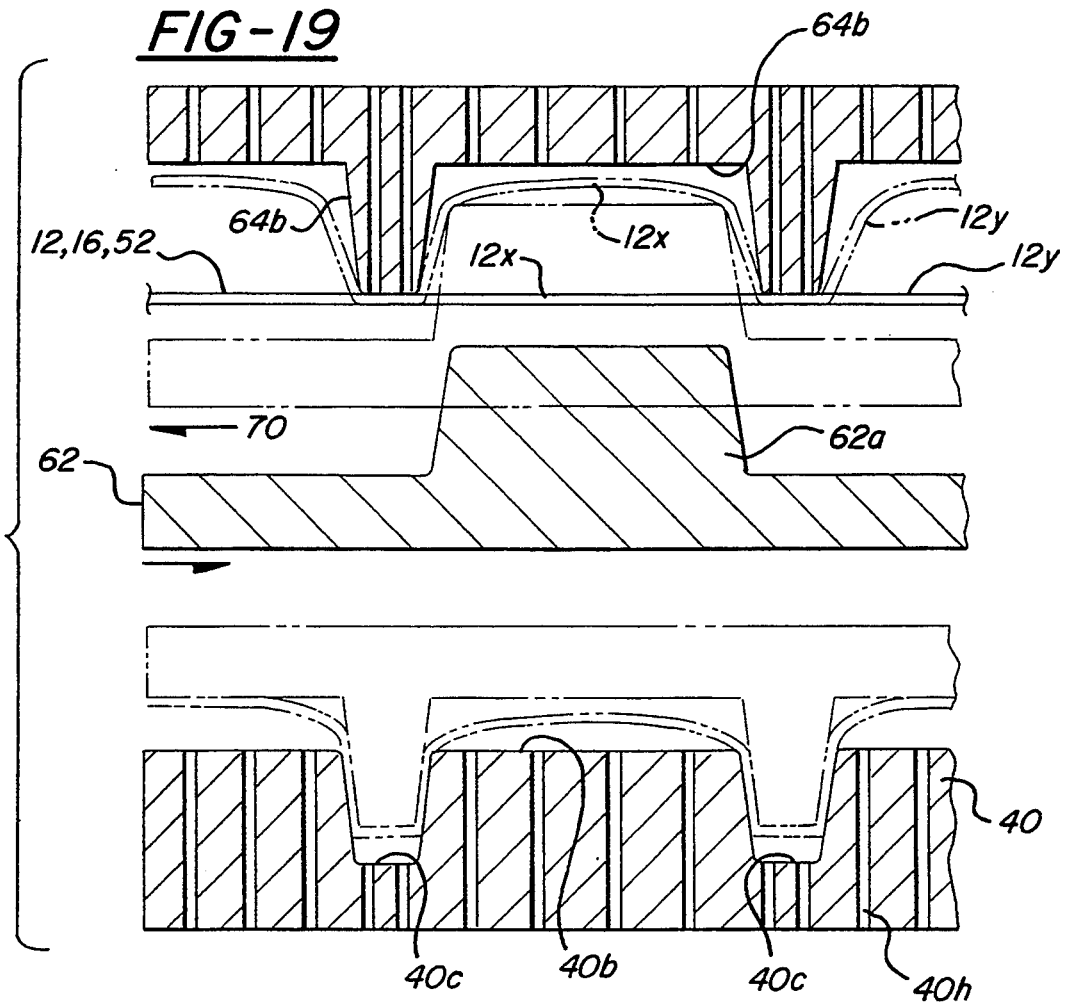

METHOD OF FORMING A PALLET

RELATED APPLICATION

This application is a continuation-in-part of U.S. patent application Ser. No. 524,299, filed on May 15, 1990, now abandoned.

BACKGROUND OF THE INVENTION

This invention relates to shipping and storage pallets and more particularly to pallets having a plastic construction.

Pallets have traditionally been formed of wood. Wood pallets, however, have many disadvantages. For example, they are subject to breakage and thus are not reusable over an extended period of time. They are also difficult to maintain in a sanitary condition, thus limiting their usability in applications where sanitation is important such, for example, as in food handling applications.

In an effort to solve some of the problems associated with wood pallets, plastic pallets have been employed with some degree of success. Specifically, although the plastic pallets heretofore employed have been durable, have been reusable over an extended period of time and have been easy to maintain in a sanitary condition, they have suffered from the disadvantage of costing considerably more than the comparable wooden pallets, thereby limiting their commercial acceptance. Although manufacturing costs are reflected in the cost of the plastic pallets, the main reason that the plastic pallets cost considerably more than the comparable wooden pallets is that they require a given amount of relatively expensive plastic material for a given measure of pallet strength and the required plastic material has a given cost that constitutes a substantial portion of the total cost of the pallet.

Certain of the prior art plastic pallets have also suffered from the disadvantage that they do not provide a smooth upper pallet surface but rather provide major hollows or concavities in the pallet load surface which interfere with the loading of small objects on the surface and tend to collect dirt and debris. For example, in one generally successful form of plastic pallet design, a twin sheet construction has been used in which upper and lower plastic sheets are formed in separate molding operations and the two sheets are then selectively fused or knitted together in a suitable press to form a reinforced double wall structure. Whereas such twin sheet plastic pallets have been generally satisfactory, they typically define large concavities in the pallet surface which interfere with the loading of small objects on the pallet and encourage the collection of debris in the concavities.

SUMMARY OF THE INVENTION

The invention is directed to the provision of a plastic pallet which is inexpensive as compared to prior art plastic pallets of similar strength.

This invention is also directed to the provision of a plastic pallet of the multiple sheet type which presents a flat upper loading surface.

This invention is further directed to the provision of an improved method of forming plastic pallets of multiple sheet construction.

The invention pallet is of the multiple sheet type in which a plurality of sheets of plastic are selectively and individually thermoformed and thereafter selectively fused together to focal the pallet.

According to an important feature of the invention, the invention pallet includes a first plastic sheet including a main body planar portion and a series of leg portions extending downwardly from the main body portion and defining a series of grooves opening in the upper face of the main body portion and a second plastic sheet including a main body planar portion corresponding generally in size and configuration to the first sheet main body portion and adapted to overlie the first sheet main body portion and a plurality of hollow pins extending downwardly from the second sheet main body portion and opening in the upper face of the second sheet main body portion. The pins are arranged in a series of pin assemblies corresponding generally in size and configuration to the grooves defined by the leg portions of the first sheet so that, in the assembled relation of the sheets, each pin assembly fits nestingly in a respective groove with the material of the pin assembly fused to the confronting material of the groove to form the pallet structure. This construction provides extremely high pallet strength for a given amount of plastic material employed to construct the pallet, so as to minimize the cost of the pallet, and further provides a smooth loading surface for the pallet devoid of major concavities.

According to a further feature of the invention, the pallet further includes a third sheet including a main body portion, corresponding generally in size and configuration to the main body portions of the first and second sheets, and a series of leg portions extending upwardly from the third sheet main body portion and defining a series of grooves opening in the lower face of the third sheet main body portion, and a fourth sheet including a main body portion, corresponding generally in size and configuration to the main body portions of the first, second, and third sheets and adapted to underlie the main body portion of the third sheet, and a plurality of hollow pins extending upwardly from the fourth sheet main body portion and opening in the lower face of the fourth sheet main body portion. The pins are arranged in a series of pin assemblies corresponding generally in size and configuration to the grooves of the third sheet so that, in the assembled relation of the third and fourth sheets, each pin assembly of the fourth sheet fits nestingly in a respective groove in the third sheet and is fused to the confronting groove structure. To complete the pallet, the lower faces of the leg portions of the first sheet are fused to the upper faces of the leg portions of the third sheet to form a double faced pallet including forklift passages defined between the joined leg portions. This construction provides a pallet having extremely high strength for a given quantity of plastic material employed and presenting a smooth loading surface to facilitate loading of the pallet and a smooth bottom surface to facilitate movement of the pallet over irregular surfaces.

According to a further feature of the invention, the pins comprise relatively long primary pins having a height greater than the depth of the grooves so that, with the primary pins nestingly inserted in the grooves, the main body portions of the first and second sheets are spaced apart, and the pallet further includes relatively short secondary pins extending upwardly from the main body portion of the first sheet and downwardly from the main body portion of the second sheet to support the main body portions in their spaced disposition. This secondary pin construction further strengthens the pallet and further facilitates the provision of an extremely strong pallet for a given quantity of plastic material.

In the disclosed embodiment of the invention, the grooves are annular, the pin assemblies are annular, the secondary pins are arranged in rows extending outwardly as rays from the annular grooves and from the annular primary pin assemblies, and the rows off, secondary pins extending upwardly from the main body portion of the first sheet are interspersed with the rows of secondary pins extending downwardly from the main body portion of the second sheet. This specific construction further strengthens the pallet and further facilitates the provision of an extremely strong pallet for a given quantity of plastic material.

According to a further feature of the invention, the pallet comprises an upper plastic sheet having a generally planar main body portion, a plurality of hollow pin portions extending downwardly from the main body portion and opening in the upper face of the main body portion, and a web portion interconnecting pairs of adjacent pin portions; and a lower plastic sheet selectively fused to the bottoms of the pin portions to form the pallet. In this construction the webs coact with the pins to provide an extremely strong pallet construction for a given quantity of plastic material.

According to a further feature of the invention, each web portion is formed as a fold extending downwardly from the main body portion with the opposite sections of the fold fused together to form a seam in the upper face of the main body portion. This specific construction further facilitates the strengthening of the pallet for a given quantity of plastic material.

According to a further feature of the invention, the lower sheet includes a main body planar portion and a series of leg portions extending downwardly from the second sheet main body portion and defining a series of grooves opening in the upper face of the second sheet main body portion, the pins are arranged in a series of pin assemblies corresponding generally in size and configuration to the grooves, and each pin assembly is fitted nestingly into a respective groove and fused to the material of the groove to form the pallet. This specific construction allow the spaced walls of the grooves to coact with the walls of the pins and with the structure of the webs to form an intricate extremely strong column structure to further strengthen the pallet.

According to an important feature of the invention methodology, an upper plastic sheet is selectively thermoformed to provide a generally planar main body portion, a plurality of hollow pin portions extending downwardly from the main body portion and opening in the upper face of the main body portion, and web portions interconnecting pairs of adjacent pin portions; a lower plastic sheet is selectively thermoformed; and the lower plastic sheet is fused to the bottoms of the pin portions of the first sheet. This methodology allows the construction of an extremely strong pallet using a minimum of plastic material In the disclosed embodiment of the invention methodology, each web portion is formed as a fold extending downwardly from the main body portion to a location above the bottoms of the pin portions with the opposite sections of the fold fused together to form a seam in the upper face of the main body portion; the step of selectively thermoforming the lower sheet comprises thermoforming the lower sheet to define a generally planar main body portion and a series of leg portions extending downwardly from the lower sheet main body portion and defining a series of grooves opening in the upper face of the lower sheet main body portion; the step of selectively thermoforming the upper sheet includes forming the pin portions as a series of pin assemblies corresponding generally in size and configuration to the grooves; and the pallet is formed by nestingly inserting each pin assembly into a respective groove and fusing material of the pin assembly to material of the groove.

The invention also discloses an improved method of forming a plastic structure of the type having first and second selectively thermoformed plastic sheet selectively fused together to form the structure. According to the invention methodology, at least one of the sheets is thermoformed by providing a mold tool having a surface configuration corresponding generally to the final surface configuration of the sheet, providing a preform tool having a surface configuration that is substantially complementary to the surface configuration of the molding tool, providing a plug assist tool having a surface configuration that is substantially complementary to the surface configuration of the preform tool, positioning the sheet between the plug assist tool and the preform tool, moving the plug assist tool and the preform tool together to preform the sheet substantially to the configuration of the preform tool, withdrawing the plug assist tool, moving the preform tool and the molding tool together with the preformed sheet carried by the preform tool to position the preformed sheet on the surface of the molding tool, and forming the preform sheet to the configuration of the molding tool. This methodology allows relatively thin plastic sheets to be deep drawn without rupturing the sheet and without creating sheet sections having thicknesses below acceptable minimum standards.

BRIEF DESCRIPTION OF THE DRAWINGS

FIG. 10 is a fragmentary view of another mold tool with a sheet of plastic material thermoformed thereover;

FIGS. 11, 12 and 13 are cross-sectional view taken respectively on lines 11—11, 12—12 and 13—13 of FIG. 10;

FIG. 14 is a fragmentary perspective view of the plastic sheet structure produced by the mold tool of FIG. 10;

FIG. 18 is a schematic view showing the formation of certain of the plastic sheets employed in the invention pallets; and FIG. 19 is a schematic view showing the formation of other of the plastic sheets employed in the invention pallets.

DETAILED DESCRIPTION OF THE PREFERRED EMBODIMENT

Figure 1:
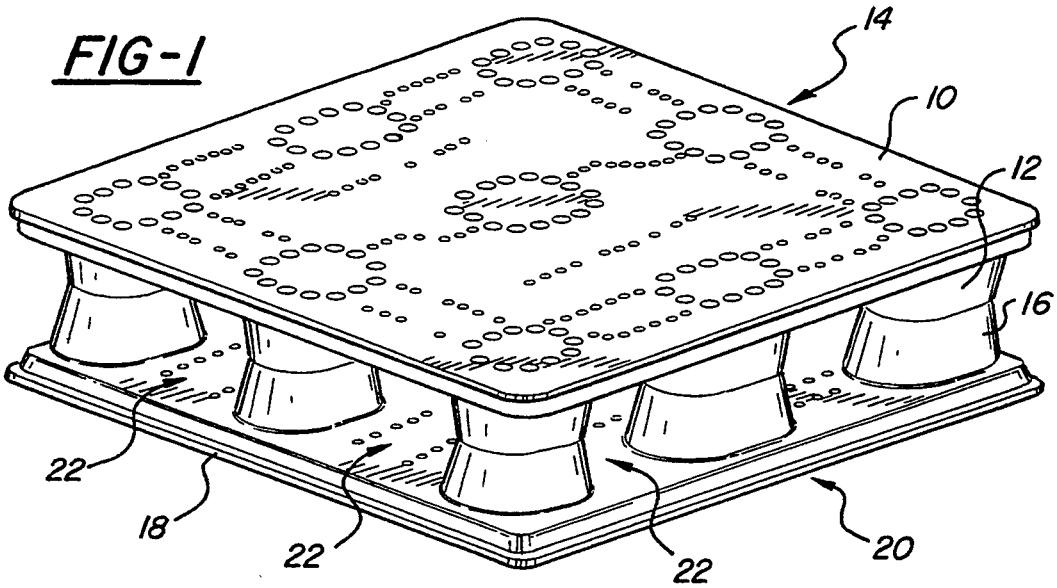
FIG. 1 is a perspective view of a pallet according to the invention.
Figure 8:
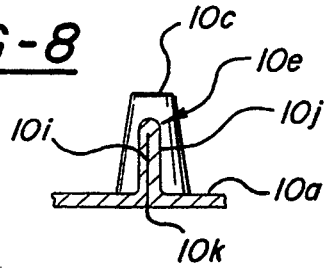
FIGS. 7 and 8 are cross-sectional views taken respectively on line 7—7 and 8—8 of FIG. 6.

The invention pallet is of the type including a plurality of plastic sheets which are selectively thermoformed and thereafter selectively fused together to form the pallet structure. Whereas the invention pallet may be constructed from any suitable thermoplastic resin material, the pallet is preferably constructed from high density polyethylene plastic sheets. The plastic sheets are typically formed in an extrusion process and are thereafter mounted onto an appropriate thermoforming vacuum mold. Each of the thermoforming vacuum molds is a one-sided mold having vacuum ports provided therein and intended to draw the sheet of material against the mold with the sheet of material being heated so as to generally conform to the shape of the mold. Following the individual formation of the plastic sheets, the sheets, still in a hot, moldable configuration, are brought together under pressure so that the sheets are fused together at their various interfaces to form the final pallet product.

The invention pallet seen in FIGS. 1–14 is formed from four plastic sheets which are individually and selectively thermoformed in a vacuum molding process and thereafter selectively fused together to form the pallet. Two of the sheets 10 and 12 are selectively fused together to form an upper or platform section 14 of the pallet and two of the sheets 16 and 18 are selectively fused together to form a lower or base section 20 of the pallet. The upper section 14 and lower section 20, when fused together, coact to define a pallet having a smooth upper platform surface to facilitate loading of the pallet and a smooth lower surface to facilitate movement of the pallet over irregular surfaces. The pallet also includes openings or tunnels 22 to facilitate handling of the pallet by material handling equipment. Sheets 10 and 18 are substantially identical and sheets 12 and 16 are substantially identical.

Figure 6:
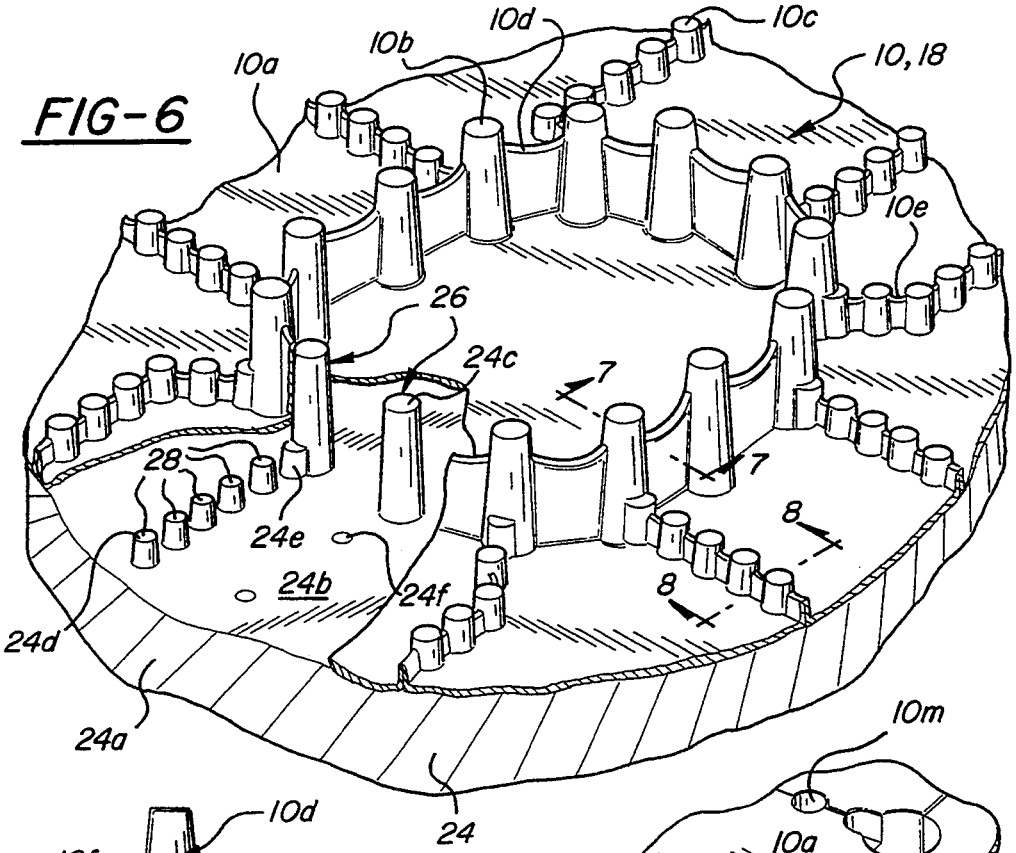
FIG. 6 is a fragmentary view of a mold tool with a sheet of plastic material thermoformed thereover.
Figure 7:
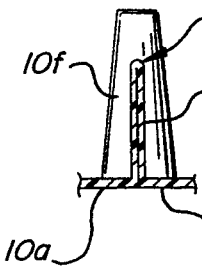

Sheets 10 and 18 are thermoformed utilizing a mold tool 24 seen fragmentarily in FIG. 6. Mold tool 24 includes a main body portion 24*a*, a molding surface 24*b*, a plurality of primary pins 24*c* upstanding from mold surface 24*b*, and a plurality of secondary pins 24*d* upstanding from mold surface 24*b*.

Primary pins 24*c* are arranged in a series of annular assemblies 26. For example, as best evidenced by FIG. 2, nine annular pin assemblies 26 may be provided arranged in a typical nine-legged pallet configuration with three assemblies along each side of the pallet and a central assembly at the midpoint of the pallet.

Secondary pins 24 are arranged in rows 28 extending generally radially outwardly from each primary annular pin assembly 26 with each row terminating in a secondary pin construction 24*e* formed as an adjunct to the primary pin 24*c* from which the row radiates.

Figure 2:
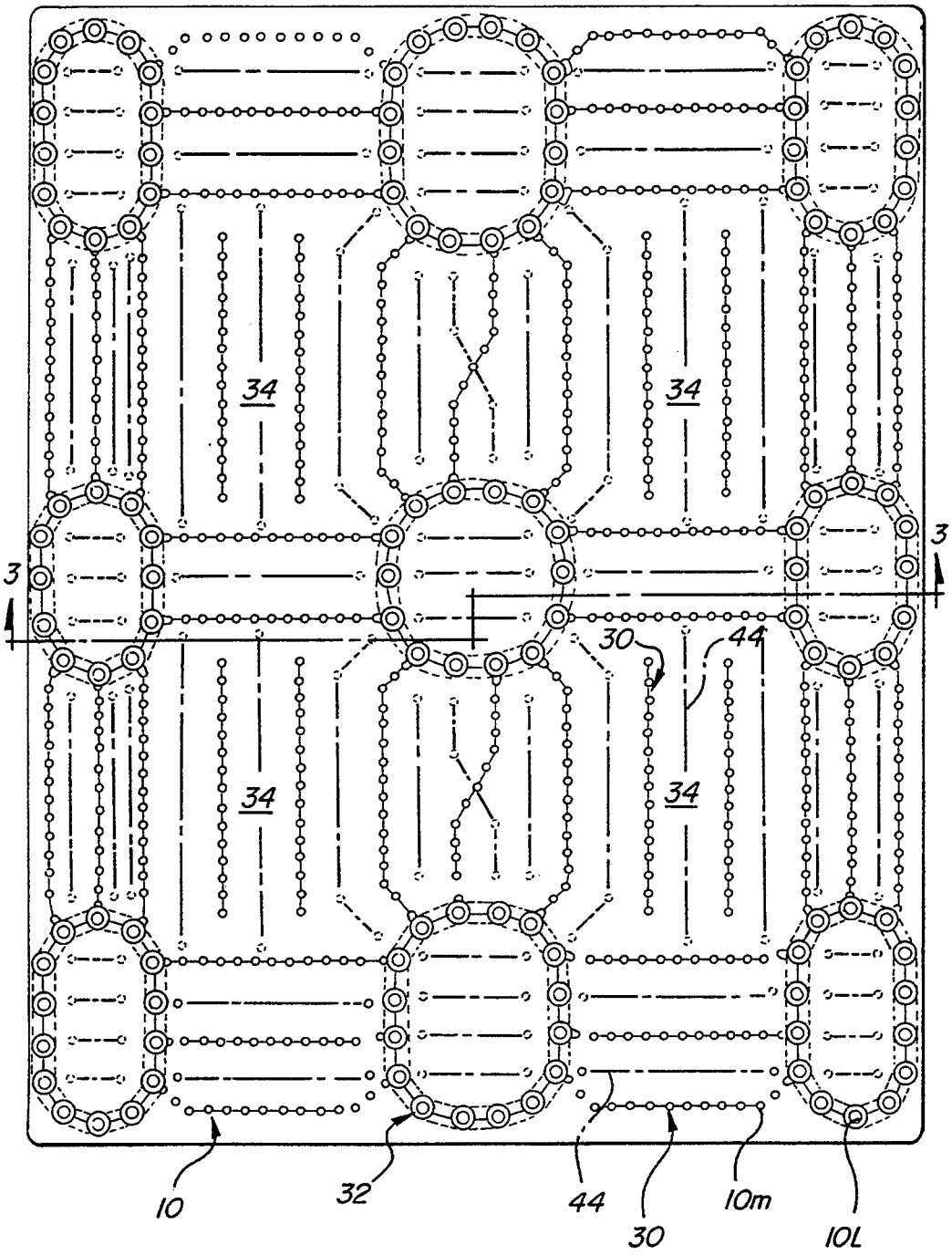
FIG. 2 is a plan view of the invention pallet.
Figure 3:
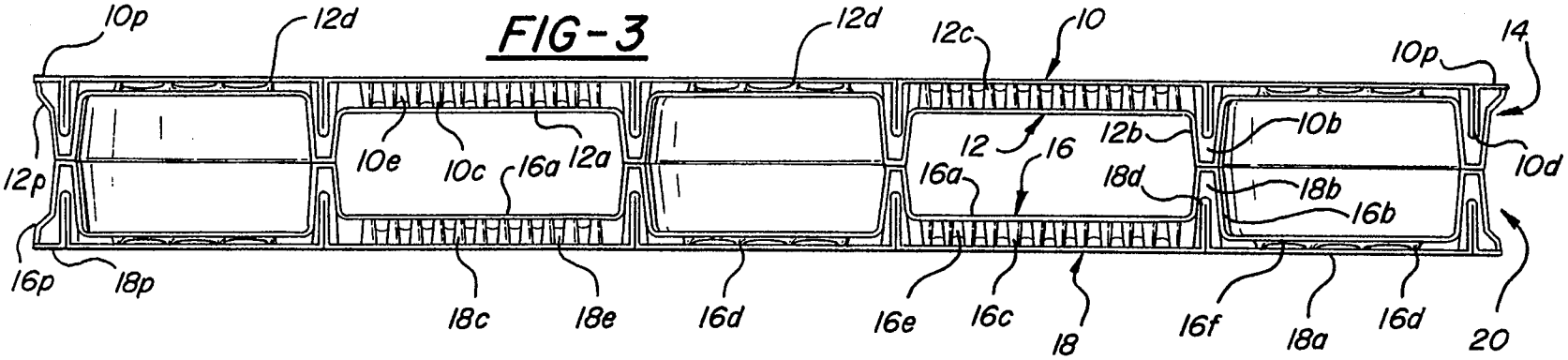
FIG. 3 is a cross-sectional view taken on line 3—3 of FIG. 2.
Figure 4:
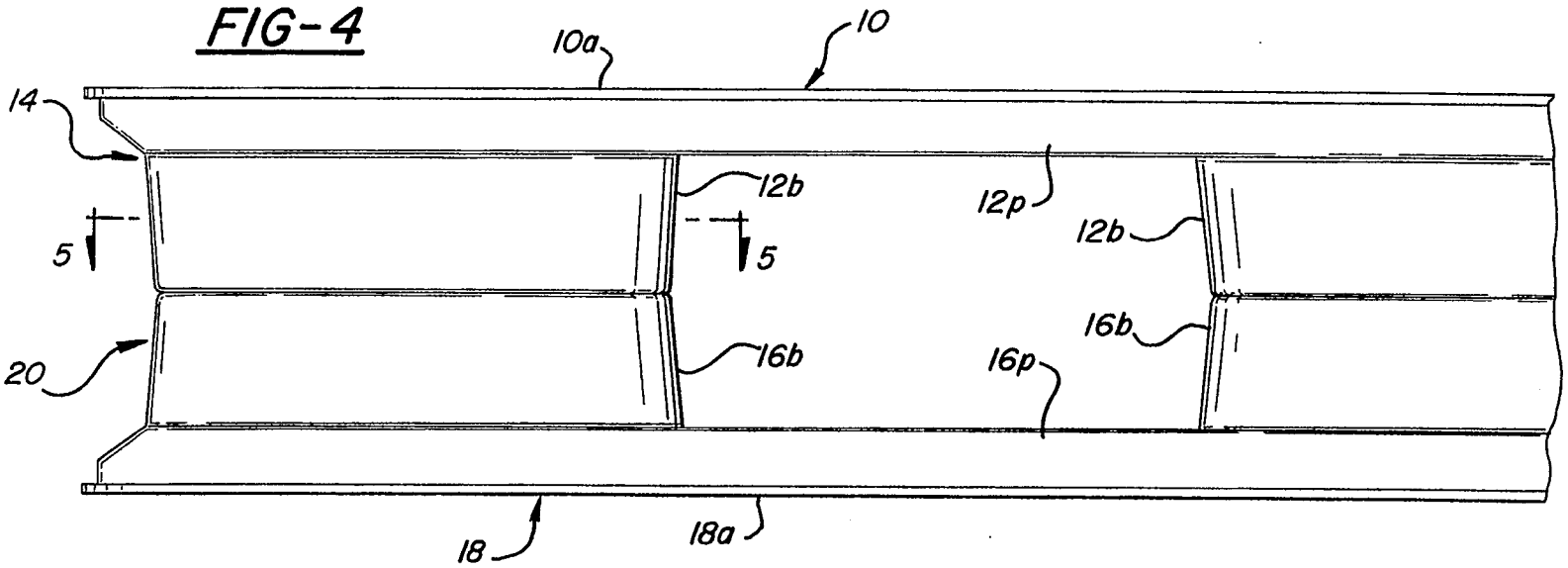
FIG. 4 is fragmentary side view of the pallet.

It will thus be understood that the mold tool 24 includes nine annular pin assemblies 26 arranged in the configuration seen in FIG. 2 as well as a plurality of radial rows 28 of secondary pins extending outwardly for connection to adjacent annular pin assemblies. The overall pattern of the rows 28 corresponds to the hole patterns 30 seen in FIG. 2 and the overall pattern of the annular primary pin assemblies 26 corresponds to the hole patterns 32 seen in FIG. 2. Note that, in addition to the secondary pin rows 28 extending between annular pin assemblies 26, secondary pin rows 28 (as evidenced by the hole patterns 30 seen in FIG. 2 in the pallet areas 34) are also provided in the areas of the mold surrounded by the various annular groupings of primary pin assemblies.

Sheets 10 and 18 are formed by drawing the heated sheets downwardly onto mold tool 24 utilizing vacuum ports 24*f* provided in the main body portion of the mold tool so that the sheets conform to the configuration of the mold tool. Specifically, sheet 10, for example, following its thermoforming onto mold tool 24, includes a main body portion 10*a*, a plurality of hollow primary pin portions 10*b*, and a plurality of hollow secondary pin portions 10*c*. Hollow primary pin portions 10*d* are arranged in a series of annular pin assemblies corresponding in size and configuration to the annular pin assemblies 26 of mold tool 24. Hollow secondary pin portions 10*c* are arranged in a series of rows corresponding in direction and disposition to the rows 28 of secondary pins 24*d* of mold tool 24.

Further, primary pin portions 20*b* are interconnected by web portions 10*d* and secondary pin portions 10*c* are interconnected by web portions 10*e*. The web portions are formed in each case as a consequence of the downward and folding movement of the plastic sheet over the primary and secondary pins of the mold tool. Specifically, each web portion 10*d* is formed as a fold extending upwardly from the main body portion 10*a* with the opposite sections 10*f* and 10*g* of the fold fused together to form a seam 10*h* in the lower face of main body portion 10*a*. Note that the web portions 10*d* have a height that is less than the height of the hollow pin portions 10*b* so that the upper edges of the web portions are positioned below the upper faces of the primary pin portions. Similarly, as the sheet material is drawn downwardly around secondary mold pins 28, web portions 10*e* are formed between each adjacent pair of pins 28 as a fold extending upwardly from the main body portion of the sheet with the opposite sections 10*i* and 10*j* of the fold fused together to form a seam 10*k* in the lower face of the main body portion 10*a*.

Figure 9:
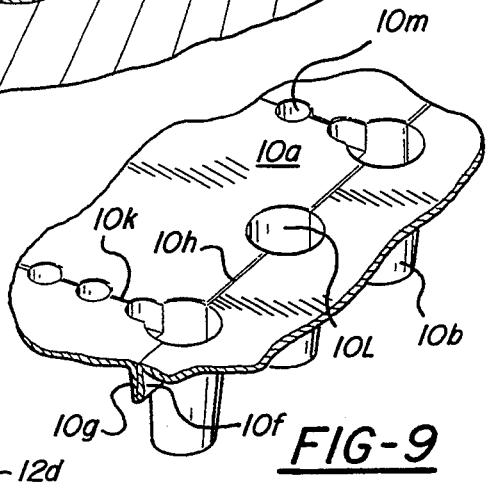
FIG. 9 is a fragmentary perspective view of the plastic sheet structure produced by the mold tool of FIG. 6.
Figure 13:
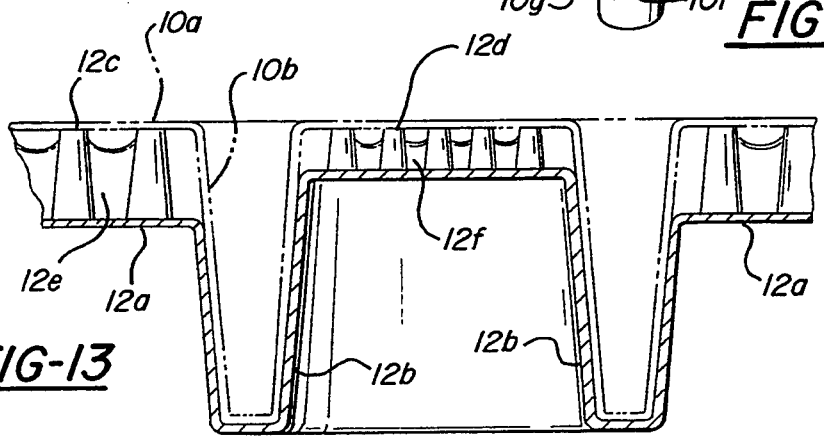

As best seen in FIG. 9, the hollow primary pin portions 10*b* open in the face of the main body portion 10*a* in circular apertures 10*l* and the hollow secondary pin portions 10*c* open in the face of the main body portion 10*a* in circular apertures 10*m* with seams 10*h* interconnecting adjacent apertures 10*l* and seams 10*k* connecting adjacent apertures 10*m*.

Sheets 12 and 16 are thermoformed utilizing a mold tool 40 seen fragmentarily in FIG. 10. Mold tool 40 includes a main body portion 40*a*, a molding surface 40*b*, a plurality of annular grooves 40*c*, a plurality of pins 40*d*, and a plurality of pins 40*e*. Annular grooves 40*c* correspond in size and configuration to pin assemblies 26 provided on mold tool 24. Pins 40*d* are arranged in rows 42 extending generally radially outwardly from each annular groove 40*c* and pins 40*e* are arranged in parallel rows upstanding from the upper surface 40*f* of the portion 40*g* of the mold tool positioned within each annular groove 40*c*. Note that the surface 40*f* of the mold tool portions 40*g* is higher than the main body portion 40*b* of the mold tool and that pins 40*d* are higher than pins 40*e* by an amount corresponding to the difference in height between the surfaces 40*b* and 40*f* so that the tops of the pins 40*d* are in the same plane as the tops of the pins 40*e*.

Rows of pins 48 extend between annular grooves 40c in the same manner as rows of pins 28 extend between annular pin assemblies 26 of the mold tool 24. The pattern of the rows 42 corresponds to the hole patterns 44 seen in dash lines in FIG. 2. As with the pin rows 28, (and as evidenced by the hole patterns 44 seen in FIG. 2 in the pallet areas 34) pin rows 42, in addition to interconnecting each set of adjacent annular grooves 40c, are also provided in the spaces 34 seen in FIG. 2.

Sheets 12/16 are formed by drawing the heated sheets downwardly onto the surface 40b of mold tool 40 utilizing vacuum ports 40h so that the sheets conform to the configuration of the mold surface defined by the mold tool. Specifically, sheet 12, for example, following its thermoforming onto mold tool 40, includes a generally planar main body portion 12a, a series of annular leg portions 12b corresponding in size and configuration to annular grooves 40c, a plurality of rows of hollow pin portions 12c extending generally radially outwardly from each annular groove 40c and corresponding in extent and orientation to pin rows 42, and a plurality of rows of pins 12d corresponding in direction and orientation to pins 40e of mold tool 40. As the sheet is drawn downwardly over the mold tool 40, web portions 12e are formed between adjacent hollow pins 12c and web portions 12f are formed between adjacent hollow pins 12d as best seen respectively in FIGS. 11 and 12.

With reference to FIG. 11, each web 12e is formed as a fold extending upwardly from the main body portion 12a of the sheet with the opposite sections 12g and 12h of the fold fused together to form a seam 12i in the lower face of main body portion 12a. With reference to FIG. 12, each web portion 12f is formed as a fold extending upwardly from main body portion 12a with the opposite sections 12j and 12k of the fold fused together to form a seam 12l in the lower face of main body portion 12a. The top edges of web portions 12e and 12f are respectively below the upper faces of pin portions 12c and 12d.

As best seen in FIG. 14, each hollow pin portion 12c opens in the surface of main body portion 12a in a circular aperture 12m and each hollow pin portion 12d opens in the sheet surface within leg portion 12b in a circular opening 12n. Adjacent apertures 12m are interconnected by a seam 12i and adjacent apertures 12n are interconnected by a seam 12l.

Sheets 10 and 12, following their vacuum forming and while still in a heated state, are selectively fused together to form the upper or platform section 14 of the pallet; sheets 16 and 18, following their vacuum forming and while still in a heated state, are selectively fused together to form the lower or base section 20 of the pallet; and upper and lower sections 14 and 20, while in a heated state, are fused together to form the completed pallet.

To form the upper pallet section 14, the sheets 10 and 12 are brought together, still in a hot flowable state, to position sheet 10 in overlying relation to sheet 12 and to nestingly position each annular assembly of pins 10b in a respective annular groove defined by a respective annular leg portion 12b. As the hot sheets are brought together, the pin portions 10b of sheet 10 fuse to the adjacent walls of the leg portions 12b; the bottom walls of the pins 10b fuse to the bottom wall of the respective leg portion 12b; the bottoms of the pins 10c fuse to the upper face of the main body portion 12a of the sheet 12; the upper faces of the pins 12d fuse to the lower face of the main body portion 10a of the sheet 10; the upper faces of the pins 12c fuse to the lower face of the main body portion 10a of the sheet 10; and the peripheral rim 10p of the sheet 10 fuses to the upper edge of the peripheral flange portion 12p defined by the lower sheet 12 to form the upper or platform section 14.

Figure 5:
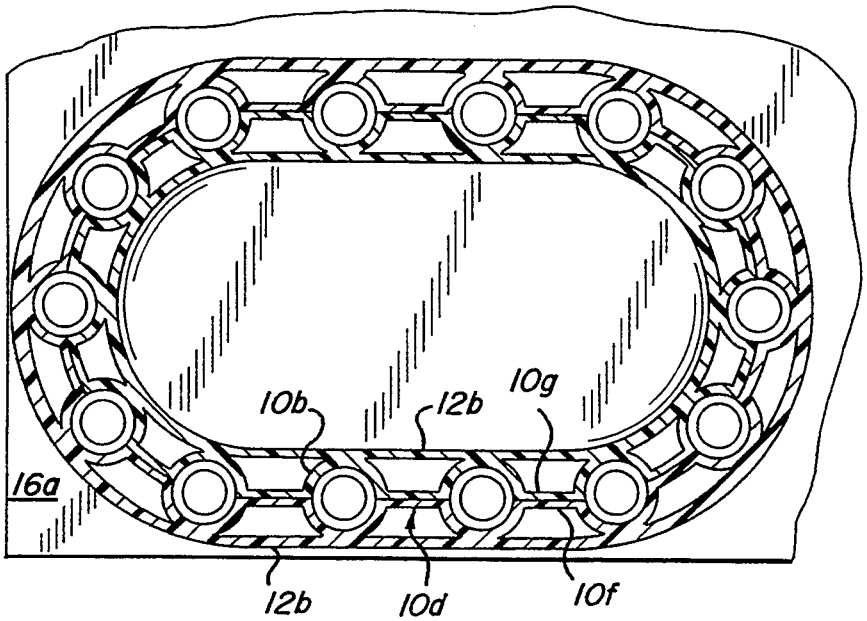
FIG. 5 is a cross-sectional view taken on line 5—5 of FIG. 4.

As best seen in FIG. 5, the fusing interaction of the pins 10b, the webs 10d, and the walls of the leg portions 12b coact to define a rigid intricate annular column structure of extremely high strength, especially in a compressive mode. Note that in the assembled fused together relation of sheets 10 and 12 to form upper pallet section 14, the rows of pins 10c alternate with the rows of pins 12c so that pin rows 10c are interspersed throughout the pallet section with pin rows 12c.

The lower or base section 16 of the pallet is formed in a manner similar to the formation of upper or platform section 14. Specifically, with sheets 16 and 18 still in a hot flowable state, the sheets are brought together to position sheet 18 below sheet 16 with the primary pin portions 18b upstanding from the main body portion 18a of the sheet 18 nestingly received in the annular grooves defined by the annular leg portion 16b of sheet 16. The hot sheets are thus fused together at their selective interfaces. Specifically, pin portions 18b fuse to the side walls of leg portions 16b; the upper faces of pin portions 18b fuse to the top walls of the leg portions 16b; the lower faces of the pin portions 16d of sheet 16 fuse to the upper face of the main body portion 18a of the sheet 18; the upper faces of the pin portions 18c of the sheet 18 fuse to the lower face of the main body portion 16a of the sheet 16; the lower faces of the pin portion 16c fuse to the upper face of the main body portion 18a of the sheet 18; and the peripheral rim 18p of the sheet 18 fuses to the lower edge of the peripheral rim 16p of the sheet 16 to form the lower or base section 20.

The pin portions 18b, the leg portions 16b, and the web portions 18d coact in the manner seen in FIG. 5 to define a series of annular, intricate cross section columns to provide extremely high compressive strength to the pallet section. As with upper pallet section 18, in the assembled relation of sheet 16 and 18 to form the lower pallet section, the rows of pin 16c alternate with the rows of pin 18c so that pin rows 16c are interspersed throughout the pallet section with pin rows 18c.

Following the formation of the upper section 14 and the lower section 20, the sections are brought together to form the final pallet. Specifically, the lower faces of the annular leg portions 12b of the upper section and the upper faces of the annular leg portions 16b of the lower section are selectively reheated (utilizing a hot platen for example) and sections 14 and 20 are brought together to fuse the heated lower faces of annular leg portions 12b to the heated upper faces of annular leg portions 16b and form the final pallet construction with the leg portions 12b and 16b coacting to define the passages or tunnels 22 for the entry of material handling equipment.

Since the openings 10l and 10m in the upper face of the pallet section 14 (as defined by the upper face of the main body portion 10a of sheet 10) are relatively small, the upper face of the pallet section 12 presents a substantially planar, smooth, uninterrupted surface which will handle even relatively small items without the danger of the items running afoul of concavities in the upper surface and without the bother of debris accumulating in concavities in the upper surface. Similarly, the openings of the hollow pins 18b and the hollow pins 18c in the bottom face of the main body portion 18*a* of the lower sheet 18 are relatively small so that the lower face of the sheet 18 presents a substantially planar smooth continuous surface to facilitate movement of the pallet over even irregular surfaces.

Figure 15:
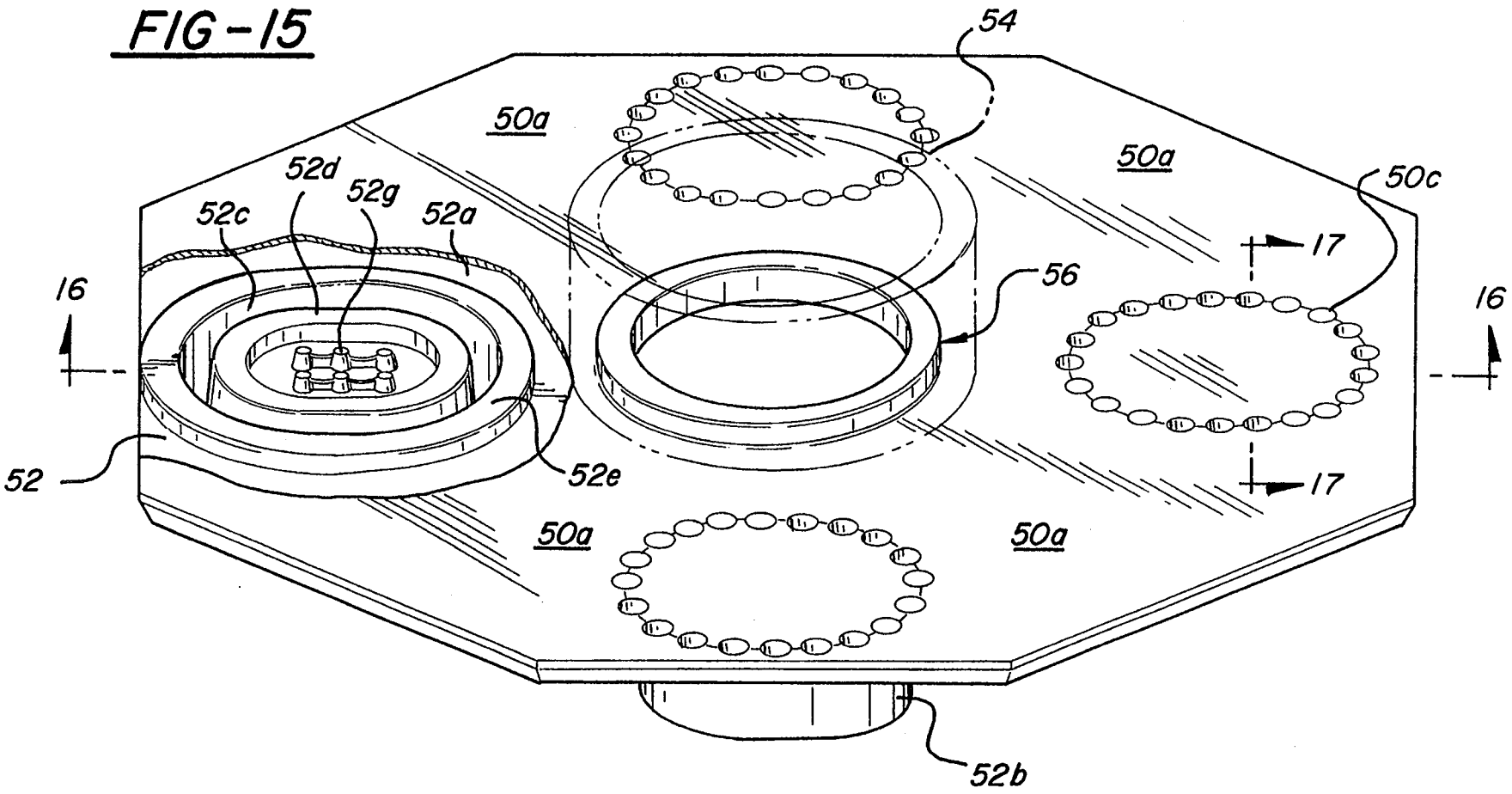
FIG. 15 is a perspective view of an alternate embodiment of the invention pallet.
Figure 16:
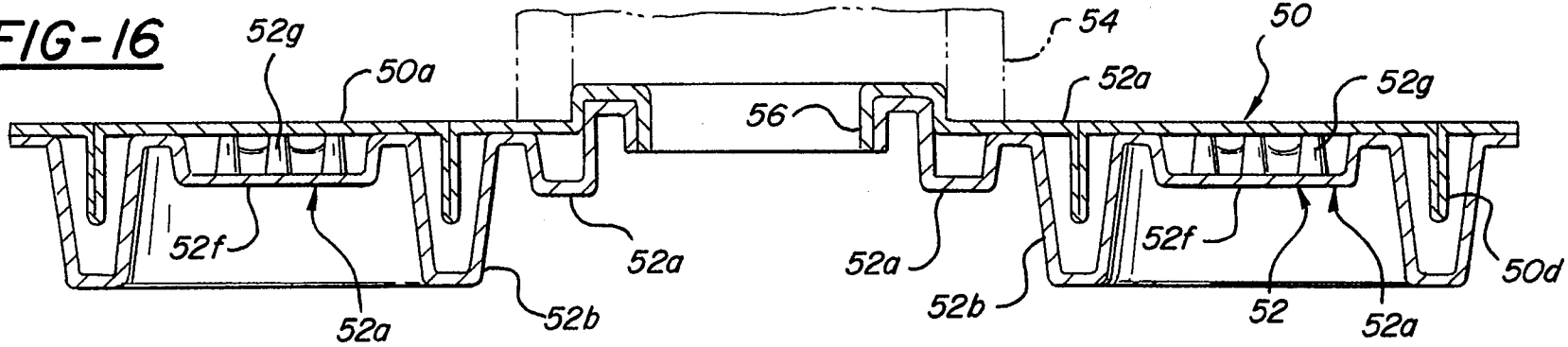
FIG. 16 and 17 are cross-sectional views taken respectively on line 16—16 and 17—17 of FIG. 15.
Figure 17:
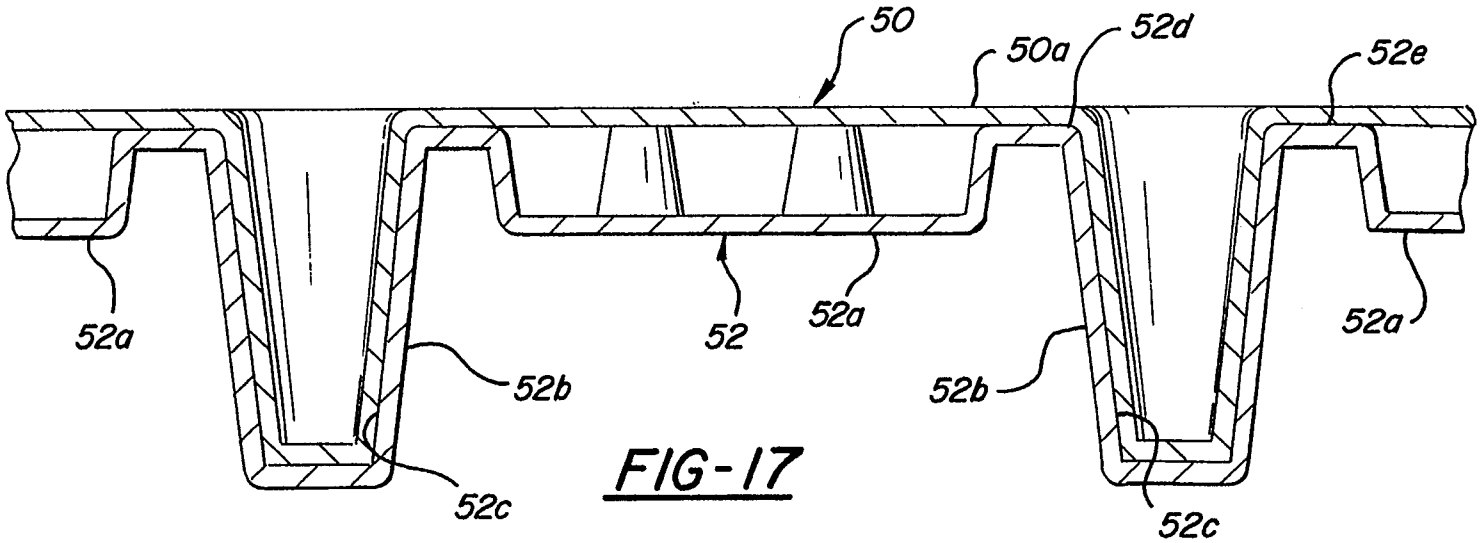

An alternate embodiment of the invention pallet is seen in FIGS. 15–17. The pallet of FIGS. 15–17 is an aluminum coil pallet of octagonal configuration formed of upper and lower plastic sheets 50 and 52 which are thermoformed and fused together in essentially the same manner as the sheets 10/11 or the sheets 16/18 of the FIGS. 1–14 embodiment.

Thus, lower sheet 52 includes a main body portion 52*a* and four circumferentially spaced annular leg portions 52*b* extending downwardly from the main body portion and defining four circumferentially spaced annular grooves 52*c* opening in the upper face of main body portion 52*a*; upper sheet 50 includes a main body portion 50*a* and a plurality of hollow pin portions 50*b* extending downwardly from main body portion 50*a*, opening in the upper face of main body portion 50*a* in apertures 50*c* interconnected by downwardly folded web portions 50*d* forming seams 50*e* in the upper face of sheet 50 extending between adjacent pairs of apertures 50, and arranged in a series of four annular pin assemblies corresponding in size and configuration to the annular grooves 52*c* defined by annular leg portions 52*b*; and the annular pin assemblies of upper sheet 50 are respectively nestingly positioned in annular grooves 52*c* and fused to the adjacent material of the grooves to form the pallet.

The pallet of FIGS. 15–17 differs from the pallet of FIGS. 1–14 in that it has an octagonal shape; in that it is formed of only two sheets of plastic rather than four; in that, since it is designed to handle an aluminum coil 54, the sheets are thermoformed to coact in the central region of the pallet to form an annular hub 56 sized to fit within an aluminum coil 56 to firmly position the coil on the upper face of the pallet; and in that the lower sheet 50 is thermoformed to include an annular rim portion 52*d* upstanding from main body portion 52*a* and surrounding the outer periphery of each annular leg portion 52*b* and an annular rim portion 52*e* upstanding from the section 52*f* of the main body portion 52*a* positioned within each annular leg portion 52*b* and extending around the inner periphery of each leg portion 52*b*. The upper annular faces of rim portions 52*d* and 52*e* are fused directly to the confronting undersurface of the main body portion 50*a* of upper sheet 50 so that lower sheet 52 is effectively brought to the top of the pallet in the annular regions located immediately outwardly and inwardly of each annular pin assembly and each annular leg portion. This annular reinforcing structure around the pin assemblies reinforces the deck of the pallet to preclude crushing of the deck in the regions of the annular pin assemblies.

The pallet of FIGS. 15–17 also includes pin portions 52*g* upstanding from each section 52*f* for fusing engagement with the undersurface of main body portion 50*a* of upper sheet 50 and a plurality of secondary pin structures (not shown), but similar to the secondary pin constructions of the FIGS. 1–14 embodiment, maintaining the main body portions of the sheets 50 and 52 in a spaced disposition in the regions of the pallet between pin assemblies.

According to an important feature of the invention methodology, individual plastic sheets 10, 12, 16 and 18 have a relatively thin thickness as compared to the sheet thicknesses employed in typical prior art multi-sheet plastic pallets so that, even though a plurality of sheets are employed to form the invention pallet, the total quantity of plastic employed is relatively small for a given measure of pallet strength so that the cost of the pallet is relatively low as compared to prior art plastic pallets. For example, whereas most prior art multi-sheet plastic pallets have utilized plastic sheets with thicknesses in the order of 0.125–0.170 inches, the methodology of the present invention allows the use of sheets having a thickness of, for example, 0.08–0.10 inches.

The use of relatively thin plastic sheets to form the invention pallet in turn has the advantage of reducing the weight of the pallet, and thereby the cost of the pallet, by a significant amount as compared to comparable prior art pallets. For example, typical prior art double faced plastic pallets, employing plastic sheets having thicknesses of 0.125–0.170 inches, have weighed between 30 and 45 pounds whereas the double faced plastic pallets of the invention (as illustrated in FIGS. 1–14), employing plastic sheets having thicknesses of 0.08–0.10 inches, weighs between 20 and 24 pounds. That is, for a given size double faced plastic pallet, the invention methodology reduces the weight, and thereby the materials cost, of the pallet by at least 33%. The ability of the invention pallet to employ relatively thin plastic sheets, and thereby employ a relatively small quantity of plastic for a given measure of pallet strength, depends upon the deep drawing techniques employed to form the pallet. These techniques are illustrated in FIGS. 15 and 16.

FIG. 18 illustrates the methodology which may be employed to form the sheets 10 and 18 of the FIGS. 1–14 embodiment and the sheet 50 of the FIGS. 15–17 embodiment. In the formation of the sheets 10, 18, and 50, a plug assist tool 60 is employed in coaction with the mold tool 24. Plug assist tool 60 has a molding surface configuration that is generally complementary to the surface configuration of the mold tool 24. Specifically, plug assist tool 60 includes a plurality of raised or plug portions 60*a* corresponding generally in size and configuration to the annular pin assemblies 26 defined on the molding surface of the mold tool 24. Prior to attempting to conform the sheet 10, for example, to the mold surface of the mold tool 24, the plug assist tool 60 is moved toward the mold tool 24 to urge portions of the hot sheet 10 upwardly into the annular cavity defined within each annular pin assembly 26 (as shown by the dotted lines in FIG. 18) whereafter the plug assist 60 is withdrawn and vacuum is applied to the molding surface of mold tool 24 through ports 24*f* to complete the sucking confirmation of the sheet 10 to the molding surface. This plug assist technology prevents the sheet from being drawn down to a thickness below acceptable levels despite the deep drawing required to wrap the sheet around the pin 10*b* and around the pins 10*c*.

Sheets 12 and 16 of the FIGS. 1–14 embodiment and sheet 52 of the FIGS. 15–17 embodiment are preferably formed by the methodology illustrated in FIG. 19. The methodology of FIG. 19 involves a plug assist tool 62, a preform tool 64, and mold tool 40.

Preform tool 64 includes a plurality of vacuum ports 64*a* and a plurality of downwardly extending annular leg portions 64*b* corresponding generally in size and configuration to the annular grooves 40*c* defined in the upper face of the mold tool 40 so that the molding surface configuration of the preform tool 64 is substantially complementary to the molding surface configuration of the molding tool 40.

Plug assist tool 62 includes a plurality of raised or plug portions 62*a* corresponding generally in size and configuration to the downwardly opening grooves 64*b* defined within each annular leg 64*a* of preform tool 64 so that the molding surface configuration of plug assist tool 62 is generally complementary to the molding surface configuration of preform tool 64.

To form the sheets 12/16/52, the heated sheet 12 (for example) is positioned between the plug assist tool 62 and the preform tool 64 whereafter the tools 62, 64 are brought together so that the plug portions 62*a* of the plug assist tool 62 serve to push portions of the sheet 12 upwardly into general conformance with the pockets 64*c* defined within the annular leg portions 64*b* of the preform tool. As the plug portions 62*b* push portions of the sheet 12 into the pockets 64*c*, vacuum is applied through port 64*a* so as to assist the plug portions in moving the sheet portions 12*x* into pockets 64*c* and so as to suck the sheet portions 12*y* into general conformance with the mold surfaces 64*d* of the preform tool. The plug assist tool is thereafter lowered and removed laterally (as indicated by the arrow 70) and the preform tool, carrying the preformed sheet 12, is moved into coaction with the mold tool 40 to position the preformed sheet on the upper molding surface of the molding tool 40 so that the sheet partially conforms to the upper molding surface of the mold tool 40, whereafter the preformed tool is raised and vacuum is applied to the molding surface of the molding tool 40 through ports 40*h* to suck the plastic downwardly into complete conformance with the molding surface of the mold tool 40 and thereby form the deep drawn annular leg portions 12*b* in addition to the other less severely drawn portion of the sheet. The multi-step operation of FIG. 19 has been found to facilitate the utilization of very thin plastic sheet material (such for example as 0.08 inches thickness) without rupturing or substantially weakening the sheet material as the sheet is deep drawn to form the annular leg portions 12*b*.

The invention will be seen to provide a pallet structure that is extremely strong, especially in compressive strength, for a given weight of plastic material employed to form the pallet. And the invention will be seen to further provide a methodology for deep drawing even very thin sheets of plastic material without rupturing the material or unduly weakening the material by the extreme thinning that would ordinarily occur during the deep drawing process.

Whereas preferred embodiments of the invention has been illustrated and described in detail, it will be apparent that various changes may be made in the disclosed embodiments without departing from the scope or spirit of the invention.

I claim:

1. A method of forming a pallet comprising:

thermoforming a first plastic sheet to provide a main body planar portion and a series of leg portions extending downwardly from said main body portion and defining a respective series of grooves opening in the upper face of said main body portion;

thermoforming a second plastic sheet to provide a main body planar portion corresponding generally in size and configuration to said first sheet main body portion and a plurality of hollow pins extending downwardly from said second sheet main body portion, opening in the upper face of said second sheet main body portion, and arranged to form a series of pin assemblies with each pin assembly comprising a plurality of pins arranged in a configuration corresponding generally in size and configuration to a respective groove; and nestingly inserting each pin assembly into a respective groove and fusing material of the pin assembly to material of the groove to form the pallet.

2. A method according to claim 1 wherein the pins of each pin assembly are arranged in an annular configuration and wherein the leg portions are formed to define a series of annular grooves for nesting receipt of the respective annular pin assemblies.

3. A method according to claim 1 including the further step of:

forming a base plastic structure; and fusing the base structure to the bottoms of the leg portions of said first plastic sheet.

4. A method according to claim 3 wherein:

said step of forming a base plastic structure comprises:

thermoforming a third plastic sheet to provide a main body planar portion and a series of leg portions extending upwardly from said main body portion and defining a respective series of grooves opening in the lower face of said third sheet main body portion;

thermoforming a fourth plastic sheet to provide a main body planar portion corresponding generally in size and configuration to said first, second and third sheet main body portions and a plurality of hollow pins extending upwardly from said fourth sheet main body portion, opening in the lower face of said fourth sheet main body portion, and arranged to form a series of pin assembly with each pin assembly comprising a plurality of pins arranged in a configuration corresponding generally in size and configuration to a respective third sheet groove; and nestingly inserting each fourth sheet pin assembly into a respective third sheet groove and fusing material of the pin assembly to material of the groove to form the base structure.

5. A method according to claim 4 wherein said step of fusing the base structure to the bottoms of the top portions of said first sheet comprises fusing the tops of the leg portions of said third sheet to the bottoms of the leg portions of said second sheet.

6. A method of forming a pallet comprising:

thermoforming a first plastic sheet to provide a generally planar main body portion, a plurality of hollow pin portions extending downwardly from said main body portion and opening in the upper face of said main body portion, and web portions interconnecting pairs of adjacent pin portions;

thermoforming a second plastic sheet; and fusing said second plastic sheet to the bottoms of said pin portions;

each web portion being formed as a fold extending downwardly from said main body portion to a location above the bottoms of said pin portions with adjacent portions of the fold fused together to form a seam in the upper face of said main body portion.

* * * * *